US006686892B1

(12) United States Patent
Lopez et al.

(10) Patent No.: US 6,686,892 B1
(45) Date of Patent: Feb. 3, 2004

(54) SWITCHABLE LENGTH WHIP ANTENNA

(75) Inventors: Alfred R. Lopez, Commack, NY (US); John F. Pedersen, Northport, NY (US); Joseph T. Merenda, Northport, NY (US)

(73) Assignee: BAE Systems-Information and Electronic Systems Integration Inc., Greenlawn, NY (US)

( * ) Notice: Subject to any disclaimer, the term of this patent is extended or adjusted under 35 U.S.C. 154(b) by 0 days.

(21) Appl. No.: 10/134,198

(22) Filed: Apr. 26, 2002

(51) Int. Cl.[7] ..... H01Q 1/24; H01Q 9/16
(52) U.S. Cl. ..... 343/791; 343/792
(58) Field of Search ..... 343/791, 792, 343/702, 900, 901, 850, 876, 790

(56) References Cited

U.S. PATENT DOCUMENTS 5,440,317 A * 8/1995 Jalloul et al. ..... 343/791
6,172,651 B1 * 1/2001 Du ..... 343/850
6,195,065 B1 * 2/2001 Hung et al. ..... 343/876

* cited by examiner

*Primary Examiner*—James Clinger
(74) *Attorney, Agent, or Firm*—Edward A. Onders; Kenneth P. Robinson

(57) ABSTRACT

A whip antenna with switchable operative length provides seven band coverage from 30 to 90 MHZ. A coaxial choke section below a fixed upper antenna element is used for the highest frequency band. A series of four coaxial line sections are switchably coupled below the choke section to increase its operative length for operation in bands of successively lower frequency. One or more lumped constant non-coaxial transmission line sections are switchably coupled below the coaxial line sections for operation in the two lowest frequency bands. Dipole level gain is provided with low reflections loss. Increased height gain is provided by height of operative antenna elements employed at higher frequency bands.

27 Claims, 5 Drawing Sheets

| SWITCH O = OPEN C = CLOSED | FREQ. BAND (MHz) | IMPEDANCE PLOT ($Z_0$ = 200 Ohms) (INNER CIRCLE VSWR = 4) | ELEVATION PLANE PATTERN (CENTER FREQUENCY) |
|---|---|---|---|
| S1 C<br>S2 C<br>S3 C<br>S4 C<br>S5 C<br>S6 C | 30-38 |  | 34 MHz   |
| S1 C<br>S2 C<br>S3 C<br>S4 C<br>S5 C<br>S6 O | 38-44 |  | 41 MHz   |
| S1 C<br>S2 C<br>S3 C<br>S4 C<br>S5 O<br>S6 O | 44-50 |  | 47 MHz   |

SWITCHABLE LENGTH WHIP ANTENNA

RELATED APPLICATIONS (Not Applicable)

FEDERALLY SPONSORED RESEARCH (Not Applicable)

BACKGROUND OF THE INVENTION

This invention relates to antennas and, more particularly, whip antennas operable over more than one frequency band.

The design and implementation of many varieties of whip antennas are well known. The dictionary definition of "a flexible radio antenna" encompasses the typical configuration of a base-supported upright element of extended length. Prior types of whip antennas are suitable for many applications, subject to inherent limitations such as usable frequency band for an individual antenna design and inadequacies where operation over a number of bands is required.

Objects of the present invention are, therefore, to provide new and improved whip antennas and such antennas having one or more of the following characteristics and advantages:

multi-band operation;

operation over a plurality of sub-bands (e.g., coverage from 30 to 90 MHz);

switch control of effective antenna length;

switchable length by electronic control;

dipole gain performance;

low reflection loss;

gain increase by increased antenna height for higher frequency bands;

simplified, low cost construction; and base mount construction.

SUMMARY OF THE INVENTION

In accordance with the invention: a whip antenna, with switchable operative length for multi-band operation, includes an upper antenna element having a vertical axis and a choke section coaxial to the vertical axis below the upper antenna element. At least one coaxial line section is positioned along the vertical axis below and spaced from the choke section. The antenna may include at least one transmission line section in a non-coaxial position relative to the vertical axis and in spaced relation below the coaxial line sections. A plurality of switch devices is arranged to selectively couple the coaxial line and transmission line sections in series with the choke section. A driver configuration is coupled to the switch devices to selectively activate the switch devices to enable operation in a plurality of frequency bands. The antenna also includes a coaxial cable extending vertically along the vertical axis through the choke section and each coaxial line section and having a center conductor connected to the upper antenna element and an outer conductor connected to the choke section.

In one embodiment of the invention, the driver configuration is arranged to selectively activate the switch devices to provide any one of the following: the combination of the upper antenna element and the choke section, comprising a dipole operable in an upper frequency band; the combination of the upper antenna element, the choke section and at least one coaxial line section, these sections coupled in series via activation of at least one switch device to comprise a dipole operable in an additional frequency band lower than such upper frequency band; and the combination of the upper antenna element, the choke section, at least one coaxial line section and at least one transmission line section, these sections coupled in series via activation of a plurality of switch devices to comprise a dipole operable in a frequency band lower than the additional frequency band.

Also in accordance with the invention, a whip antenna, with switchable operative length for multi-band operation, and having an upper antenna element and choke section as described above may include first, second, third and fourth coaxial line sections respectively positioned below the choke section at successively lower positions. A plurality of switch devices is arranged to selectively couple to the choke section any one of (a) the first coaxial line section, (b) the first and second coaxial line sections, (c) the first, second and third coaxial line sections, and (d) the first second, third and fourth coaxial lines sections. In a particular configuration to provide operational coverage from 30–90 MHz, components of the antenna may have nominal vertical dimensions as follows:

upper antenna element, 1.30 meters;

choke section, 0.60 meters;

first coaxial line section, 0.52 meters;

second coaxial line section, 0.36 meters;

third coaxial line section, 0.13 meters; and fourth coaxial line section, 0.08 meters.

For a better understanding of the invention, together with other and further objects, reference is made to the accompanying drawings and the scope of the invention will be pointed out in the accompanying claims.

DESCRIPTION OF THE INVENTION

Figure 1:
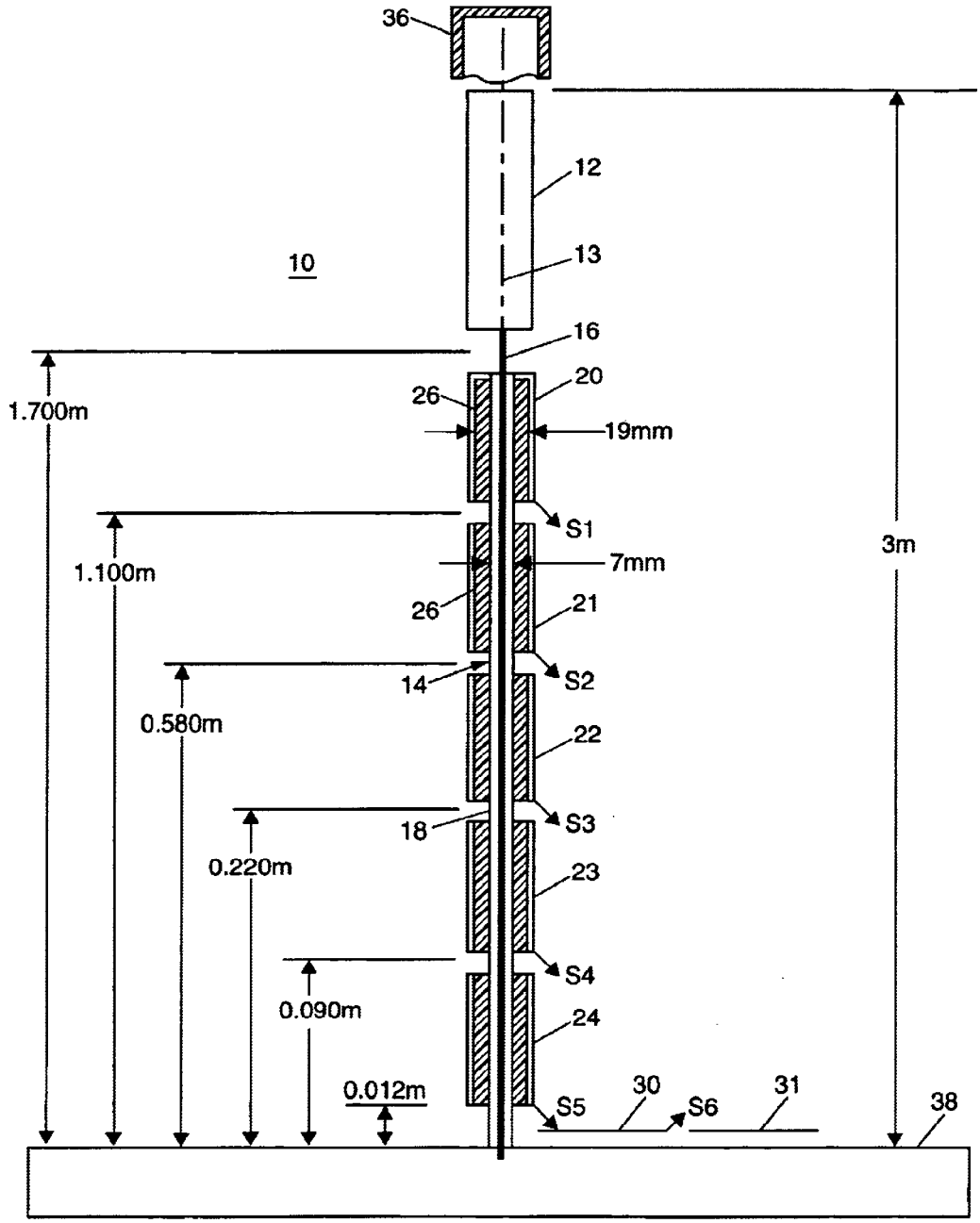
FIG. 1 is a not-to-scale schematic block diagram of a whip antenna pursuant to the invention.

FIG. 1 is a side view of an embodiment of a whip antenna 10 with switchable operative length for multi-band operation pursuant to the invention. FIG. 1 is a simplified not-to-scale side view, partially cross-sectioned and including switch devices shown schematically. Certain dimensions are distorted for purposes of illustration. As indicated by dimensional values in FIG. 1, in this embodiment the antenna has an overall vertical height of 3 meters, with the upper antenna element 12 having a length of approximately 1.3 meters. As will be further described, the FIG. 1 antenna is configured for operation in frequency bands over a range from 30 to 90 MHz.

Antenna 10 is arranged to operate as a half-wave dipole. The upper antenna element 12, having a fixed length and a vertical axis 13, is mounted above a lower antenna portion of switchable operative length selectable for operation in a plurality of frequency bands. Element 12 is shown connected to inner conductor 16 of a vertical coaxial cable 14 having an outer conductor 18.

As shown, a choke section 20 is coaxial to the vertical axis 13 below the upper antenna element 12. Choke section 20 includes a cylindrical conductive portion coaxial to the vertical axis 13 and a flat conductive top portion conductively connected to the upper end of outer conductor 18 of cable 14. Dielectric material 26 between choke section 20 and cable 14 aids in maintaining the choke section in position relative to the cable 14.

The FIG. 1 whip antenna includes four coaxial line sections 21, 22, 23, 24 in successively lower positions along the vertical axis 13 below the choke section 20. Shown sectioned, the coaxial line sections are spaced from choke section 20 and from each other along cable 14. Coaxial line sections 21–24 are formed of cylindrical conductive portions and shown supported by dielectric material 26 surrounding the outer conductor 18 of the coaxial cable 14.

The antenna 10 additionally includes two transmission line sections 30, 31 which are non-coaxial to the vertical axis 13. Transmission line sections 30, 31, which may be lumped constant line sections (e.g., comprising series inductances, with shunt capacitances) are shown positioned in spaced relation below the coaxial line sections 21–24. While line sections 30, 31 are represented by straight line sections for purposes of simplified illustration, physically-small, lumped constant construction may be employed, with line sections 30, 31 housed within a small enclosure at or contiguous to the base of the antenna, for example.

Also shown in FIG. 1 are a plurality of switch devices S1, S2, S3, S4, S5, S6, which are arranged to selectively couple coaxial line sections 21–24 and transmission line sections 30, 31 in series with the choke section 20. Illustrated in simplified fashion in FIG. 1, the switch devices S1–S6 may be diode type devices or other suitable devices to provide a switching function to be described further with reference to the drive configuration shown in FIG. 2. Basically, with all of switches S1–S6 open, choke section 20 in combination with upper antenna element 12 provides a dipole configuration usable in a particular frequency band (e.g., 80–90 MHz). By closure of switch device S1 choke section 20 and coaxial line section 21 are connected in series to provide an operative choke of extended length usable in a lower frequency band (e.g., 70–80 MHz).

In the FIG. 1 embodiment, there is included a cylindrical dielectric radome 36, a portion of which is shown in cross section above upper antenna element 12. Radome 36 may be constructed of any suitable material, with an inner diameter permitting the radome to be positioned down over element 12 and sections 20–24 to appropriately encompass, protect and support the antenna elements in cooperation with base, support, enclosure and other components suitable to enable antenna installation, support, operation and feed cable interconnection. Base 38 may be of any suitable form and construction appropriate to position the antenna upright in a desired location. Such aspects may be addressed by skilled persons having an understanding of the invention. By way of example, coaxial cable 14 may comprise a section of 50 ohm cable having an outer conductor of nominally 0.7 mm outside diameter and the choke and coaxial line sections may be formed of metal or other thin conductive material in cylindrical form of nominally 19 mm inside diameter. Dielectric material 26 may comprise suitable foam or other low dielectric constant material or spacers employed in a continuous, discontinuous or spaced configuration, for example, to aid in support of sections 20–24.

Figure 2:
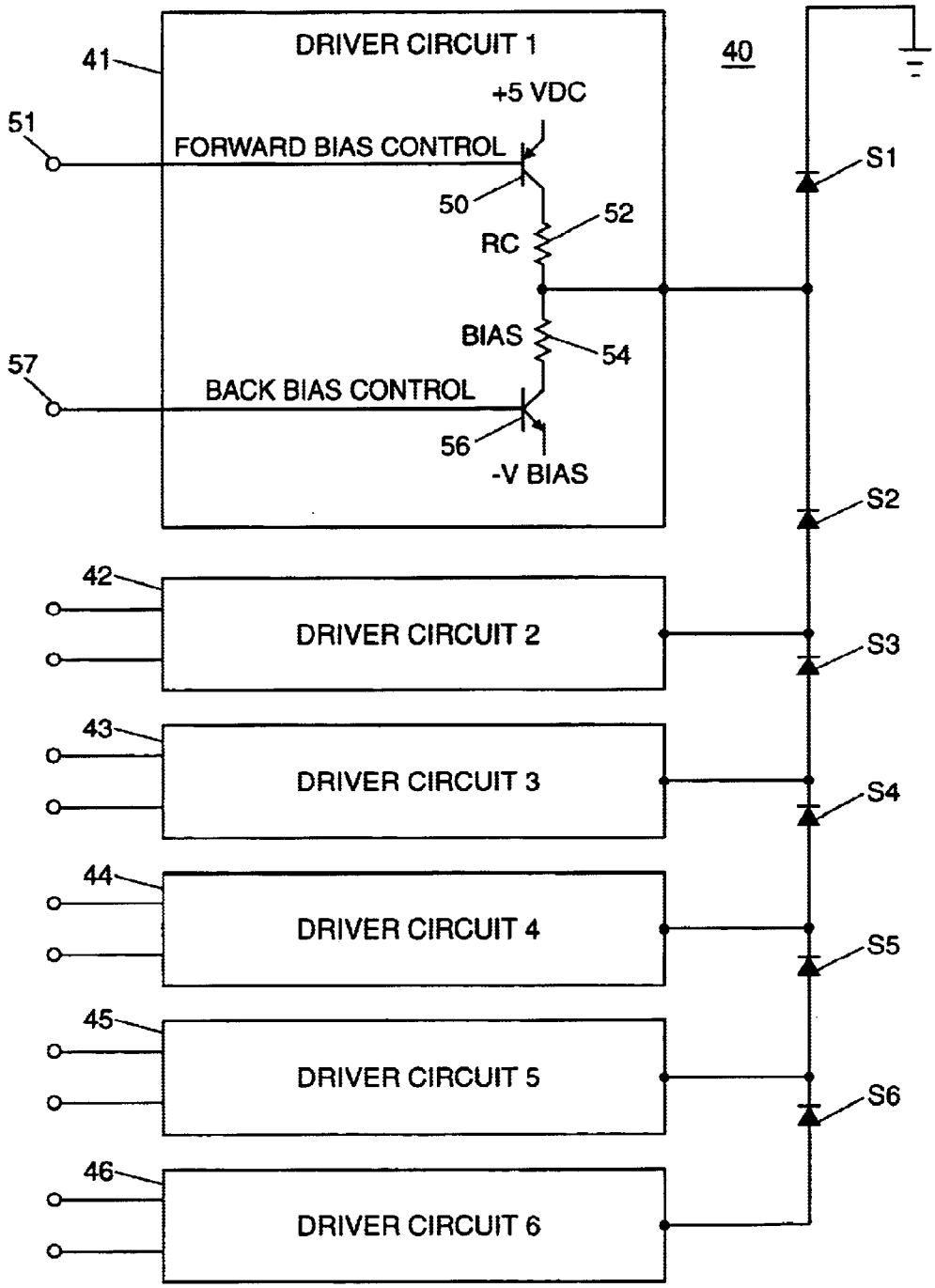
FIG. 2 is a simplified circuit diagram of a switch driver configuration usable in the FIG. 1 whip antenna.

FIG. 2 illustrates an embodiment of a driver configuration 40 usable to selectively activate switch devices S1–S6 of the FIG. 1 antenna. In this example, driver configuration 40 includes driver circuits 41, 42, 43, 44, 45, 46 shown as respective driver circuits 1–6. Driver circuits 42–46 are shown in simple block format and may each include the circuit illustrated for driver circuit 41, subject to changes in one or more of the particular circuit component values or characteristics, as will be discussed. In FIG. 2, switch devices S1–S6 are shown as diode devices (e.g., PIN diodes) whose conductivity state is controlled by the driver circuits 41–46, to permit the switch devices to be selectively activated to enable operation of the FIG. 1 whip antenna in a plurality of frequency bands.

While any suitable implementation may be provided, in FIG. 2 driver circuit 41 includes a series arrangement of semiconductor device 50 (e.g., a transistor), control resistance 52, bias resistance 54, and semiconductor device 56. As shown, in this example a +5VDC supply is connected to device 50 and a −V Bias supply is connected to device 56. A connection to device 50 permits a forward bias control voltage to be applied via terminal 51 and a connection to device 56 permits a back bias control voltage to be applied via terminal 57. Driver circuit 41 is coupled to switch device S1 via a connection from the common point between resistances 52 and 54. As noted, driver circuits 42–46 may comprise circuits corresponding to that of driver circuit 41, although values and components may differ. Thus, driver circuits 41–46 comprise separate control circuits for switch devices (e.g., PIN diodes) S1–S6, enabling selective activation thereof.

With the driver configuration as shown in FIG. 2, separate controls for forward biasing each of the PIN diode switches S1–S6, as well as for back biasing each of them, are provided. For use of the antenna in the highest frequency band (e.g., 80–90 MHz) with operative inclusion of only choke section 20, back bias is applied to all six PIN diode switches S1–S6 so that all are in an OFF or open switch state. For use of the antenna in the adjacent next lower band (e.g., 70–80 MHz), switch device S1 is forward biased to an ON or closed state and all of the other switch devices S2–S6 are back biased to an OFF or open state. As a result, switch device S1 connects coaxial line section 21 to choke section 20 and, with the choke thus switchably lengthened, the antenna is usable in the next lower frequency band (e.g., 70–80 MHz). In this condition, with S1 biased ON, the current through PIN diode S1 is limited by resistance 52.

For successively lower frequency bands additional switch devices are successively biased ON. Thus, for the next lower frequency band PIN diodes S1 and S2 are biased ON to further switchably increase the choke length by coupling coaxial line sections 21 and 22 together and to choke section 20. In order to provide a nominally identical PIN diode current in each configuration, a different value for resistance 52 may be provided in each successive driver circuit so that such resistance, together with the series voltage drop across each PIN diode in an ON condition, results in approximation of a predetermined current regardless of how many of the PIN diodes are in an ON condition. Thus, progressively smaller values for resistance 52 are used in each successive driver circuit from unit 41 to unit 46. When PIN diode switches S1 and S2 are ON, driver circuit 2 (unit 42) provides the driver current, driver circuits 3–6 (units 43–46) provide back bias, and driver circuit 1 (unit 41) is totally deactivated. In general, with six driver circuits as shown, for any group of PIN diode switches S1 to SN being ON, driver circuits 1 to N−1 are totally deactivated, driver circuits N+1 to 6 provide back bias, and only driver circuit N provides forward bias. Thus, with only one driver circuit providing forward bias (e.g., driver circuit 4), it is effective to close its switch device (i.e., S4) and all lower numbered switch device (i.e., S1, S2 and S3) and thereby couple coaxial line sections (i.e., 24, 23, 22 and 21) to choke section 20. For control of the driver circuits in this manner, a suitable form of control unit or circuit (not shown) may be connected to terminals 51 and 57 of driver circuit 41 and to corresponding terminals of driver circuits 42–46.

With activation of switch devices S1–S6 (e.g., PIN diode switches S1–S6 of FIG. 2) of antenna 10 in this manner:

switch device S1 can be activated (e.g., put in a closed state) to connect choke section 20 and coaxial line section 21, for antenna use in a 70–80 MHz band;

switch devices S1 and S2 can be activated to connect choke section 20 and coaxial line sections 21 and 22, for antenna use in a 58–70 MHz band;

switch devices S1, S2 and S3 can be activated to connect choke section 20 and coaxial line sections 21, 22 and 23, for antenna use in a 50–58 MHz band;

switch devices S1, S2, S3 and S4 can be activated to connect choke section 20 and coaxial line sections 21, 22, 23 and 24, for antenna use in a 44–50 MHz band;

switch devices S1, S2, S3, S4 and S5 can be activated to connect choke section 20, coaxial line sections 21–24 and non-coaxial transmission section 30, for antenna use in a 38–44 MHz band; and switch devices S1, S2, S3, S4, S5 and S6 can be activated to connect choke section 20, coaxial line sections 21–24 and non-coaxial transmission line sections 30 and 31, for antenna use in a 30–38 MHz band.

Figure 3:
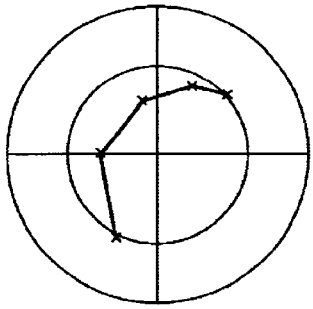
FIGS. 3 and 4 show switch device selective activation states for seven frequency bands, with computed impedance and elevation coverage pattern data for each band.
Figure 3:
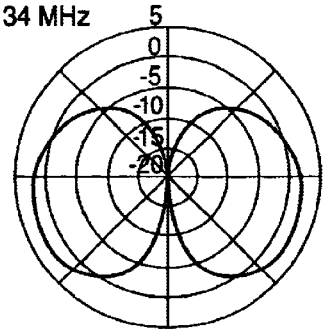
Figure 3:
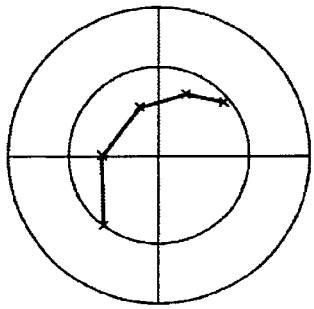
Figure 3:
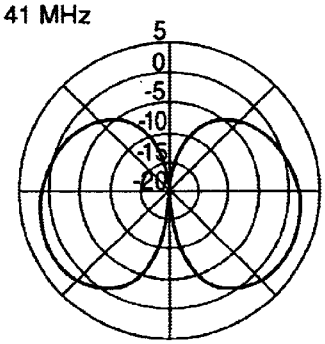
Figure 3:
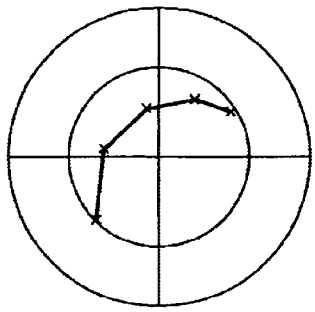
Figure 3:
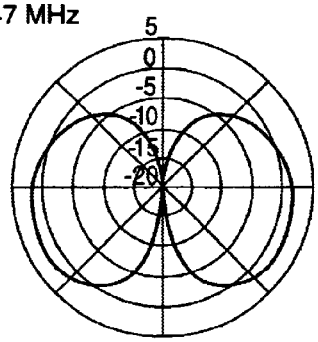
Figure 4:
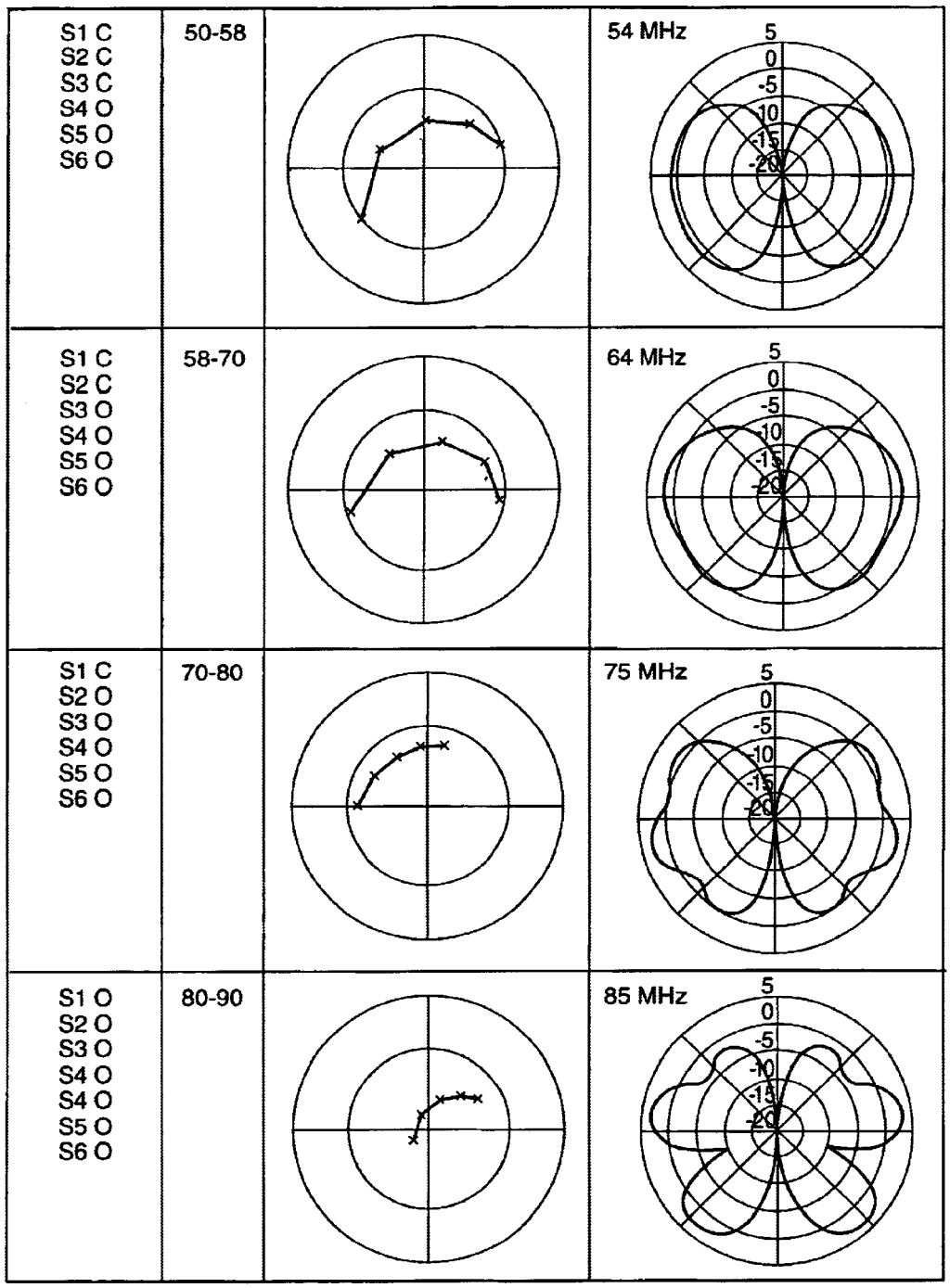

The above frequency bands and respective switch status are also indicated in FIGS. 3 and 4, with related impedance plots and elevation plane antenna patterns as computed for each frequency band. It will thus be seen that, whereas coaxial line sections 21–24 can be employed to effectively extend the operative physical length of the choke section 20, transmission line sections 30 and 31 (which may be lumped constant line sections) can be employed to effectively further extend the operative choke parameters electrically.

With reference to FIG. 1, in addition to the previously discussed physical characteristics of the whip antenna as illustrated, dimensions shown as nominal distances above an antenna base level are representative of the choke and coaxial line section lengths employed to enable operation in the above noted frequency bands in a presently preferred embodiment. Vertical gaps between adjacent sections can be assumed to be the minimum usable with appropriate inclusion of a PIN diode arranged to function as an interconnecting switch device (e.g., switch device S1). Thus, line section 24 has a nominal vertical length of 0.078 m (0.090 m–0.012 m) as illustrated. Correspondingly, choke section 20 has a nominal vertical length of 0.600 m. For purposes hereof, the term "nominal" refers to a value, dimension, etc., which is within plus or minus twenty per cent of a stated value or figure.

Figure 5:
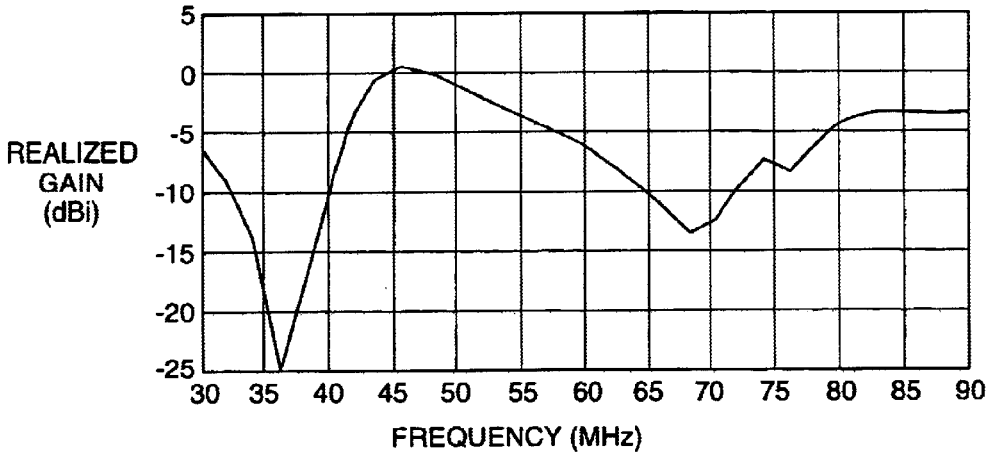
FIG. 5 shows computed values of realized gain on horizon over the 44–50 MHZ band for the FIG. 1 whip antenna.
Figure 6:
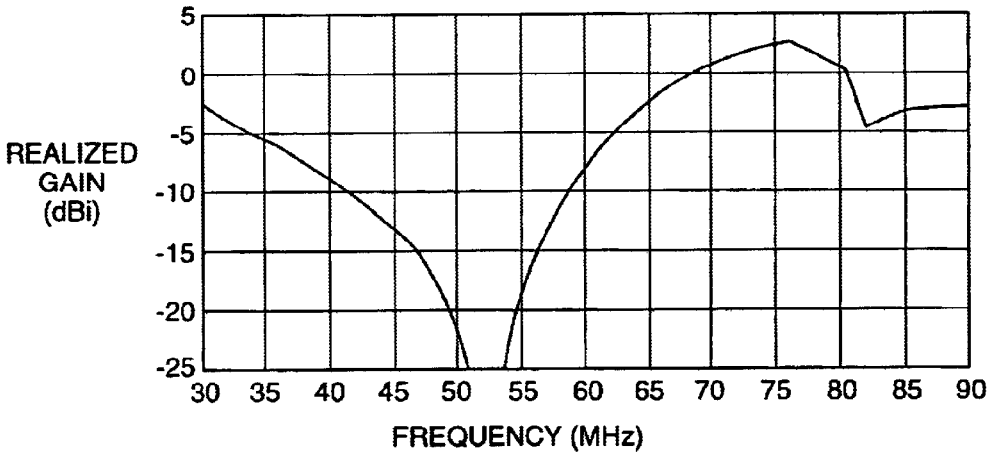
FIG. 6 shows computed values of realized gain on horizon over the 70–80 MHZ band for the FIG. 1 whip antenna.

As a feature of this configuration employing a choke whose operative length is switchably selectable, the operative antenna is effectively positioned at a higher position above its base or ground for higher frequency operation. Thus, for the 80–90 MHz band as discussed, the operative portion of the whip antenna basically comprises upper antenna element 12 and choke section 20, whose lower end is 1.1 m above the base, as shown. By contrast for the 30–38, 38–44 and 44–50 MHz bands the operative portions of the antenna extend to or close to the antenna base, so that the operative antenna is not in a raised position as it is for operation in higher frequency bands. In addition to the impedance and pattern data provided in FIGS. 3 and 4, computer generated plots of realized gain versus frequency are provided in FIGS. 5 and 6. FIG. 5 shows realized gain on horizon data for the 44–50 MHz band and FIG. 6 provides such data for the 70–80 MHz band. As shown, relatively high dipole gain is provided within the particular designated band of operation and falls off at frequencies outside the designated band in each of FIGS. 5 and 6.

A seven band whip antenna utilizing four selectable coaxial line sections and two selectable non-coaxial transmission line sections has been described. As appropriate for particular applications, frequencies and multi-band coverage requirements, other embodiments may be designed for operation at different frequencies and may include additional or fewer coaxial line sections and additional, fewer, or no non-coaxial lumped constant line sections, as determinable by skilled persons having an understanding of the invention.

While there have been described the currently preferred embodiments of the invention, those skilled in the art will recognize that other and further modifications may be made without departing from the invention and it is intended to claim all modifications and variations as fall within the scope of the invention.

What is claimed is:

1. A whip antenna, with switchable operative length for multi-band operation, comprising:

an upper antenna element having a vertical axis;

a choke section coaxial to said vertical axis below the upper antenna element;

at least one coaxial line section along said vertical axis below and spaced from the choke section;

at least one transmission line section non-coaxial to said vertical axis in spaced relation below the at least one coaxial line section;

a plurality of switch devices arranged to selectively couple the coaxial line and transmission line sections in series with the choke section; and a driver configuration coupled to the switch devices to selectively activate the switch devices to change the operative length of the antenna to enable operation in a plurality of frequency bands.

2. A whip antenna as in claim 1, further comprising:

a coaxial cable extending vertically along the vertical axis through the choke section and each coaxial line section and including a center conductor connected to the upper antenna element and an outer conductor connected to the choke section.

3. A whip antenna as in claim 2, wherein the choke and coaxial line sections include conductive cylindrical portions spaced from the outer conductor of said coaxial cable and further comprising:

dielectric material between said conductive cylindrical portions and said outer conductor.

4. A whip antenna as in claim 1, further comprising:

a cylindrical radome enclosing at least the upper antenna element, choke section and each coaxial line section.

5. A whip antenna as in claim 1, wherein the driver configuration is arranged to selectively activate the switch devices to provide any one of the following:

the combination of the upper antenna element and the choke section, comprising a dipole operable in an upper frequency band;

the combination of the upper antenna element, the choke section and at least one coaxial line section, said sections coupled in series via activation of at least one switch device to comprise a dipole operable in an additional frequency band lower than said upper frequency band; and the combination of the upper antenna element, the choke section, at least one coaxial line section and at least one transmission line section, said sections coupled in series via activation of a plurality of switch devices to comprise a dipole operable in a frequency band lower than said additional frequency band.

6. A whip antenna, with switchable operative length for multi-band operation, comprising:

an upper antenna element having a vertical axis;

a choke section coaxial to said vertical axis below the upper antenna element;

a first coaxial line section along said vertical axis below and isolated from the choke section;

a second coaxial line section along said vertical axis below and isolated from the first coaxial line section;

a first switch device arranged to selectively couple the first coaxial line section to the choke section;

a second switch device arranged to selectively couple the second coaxial line section to the first coaxial line section; and a driver configuration coupled to the switch devices to enable selective activation thereof to change the operative length of the antenna.

7. A whip antenna as in claim 6, further comprising:

a coaxial cable extending vertically along the vertical axis through the choke section and each coaxial line section and including a center conductor connected to the upper antenna element and an outer conductor connected to the choke section.

8. A whip antenna as in claim 7, wherein the choke and coaxial line sections include conductive cylindrical portions spaced from the outer conductor of said coaxial cable and further comprising:

dielectric material between said conductive cylindrical portions and said outer conductor.

9. A whip antenna as in claim 6, further comprising:

a cylindrical radome enclosing at least the upper antenna element, choke section and each coaxial line section.

10. A whip antenna as in claim 6, wherein said coaxial line sections are arranged to downwardly increase the effective length of the choke section for operation in successively lower frequency bands as the first and second switch devices are successively activated from open to closed states.

11. A whip antenna as in claim 6, wherein the driver configuration is arranged to selectively activate the switch devices for operation in an upper frequency band with both switch devices in open states, operation in a lower frequency band with the first switch device in a closed state and the second switch device in an open state, and operation in a still lower frequency band with the first and second switch devices in a closed state.

12. A whip antenna as in claim 6, wherein the driver configuration is arranged to enable any one of the following selective activations of the switch devices:

(a) both switch devices in open states, (b) first switch device in closed state and second switch device in open state, and (c) both switch devices in closed states;

the selective activations (a), (b) and (c) enabling operation in successively lower frequency bands.

13. A whip antenna as in claim 6, further comprising:

at least one additional coaxial line section along said vertical axis below and isolated from all other coaxial line sections; and at least one additional switch device arranged to selectively couple said at least one additional coaxial line section in series with other said coaxial line sections;

said driver configuration coupled to said at least one additional switch device to enable selective activation thereof.

14. A whip antenna as in claim 6, further comprising:

at least one transmission line section non-coaxial to said vertical axis; and at least one additional switch device arranged to selectively couple said at least one transmission line section in series with said coaxial line sections;

said driver configuration coupled to said at least one additional switch device to enable selective activation thereof.

15. A whip antenna, with switchable operative length for multi-band operation, comprising:

an upper antenna element having a vertical axis;

a choke section coaxial to said vertical axis below the upper antenna element, the combination of the upper antenna element and choke section operable as a dipole antenna in an upper frequency band;

a first coaxial line section along said vertical axis below and isolated from the choke section, the combination of the upper antenna element with the choke and coaxial line sections operable as a dipole antenna in a lower frequency band;

a switch device arranged to selectively couple the first coaxial line section to the choke section; and a driver configuration coupled to the switch device to selectively activate the switch device to couple the first coaxial line section to the choke section for operation in the lower frequency band.

16. A whip antenna as in claim 15, further comprising:

a second coaxial line section along said vertical axis below and isolated from the first coaxial line section, the combination of the upper antenna element with the choke and both coaxial line sections operable as a dipole antenna in a further frequency band below said lower frequency band; and a second switch device arranged to selectively couple the first and second coaxial line sections;

the driver configuration arranged to selectively activate both switch devices to couple the choke section, first coaxial line section and second coaxial line section in series for operation in said further frequency band.

17. A whip antenna as in claim 15, further comprising:

a coaxial cable extending vertically along the vertical axis through the choke section and each coaxial line section and including a center conductor connected to the upper antenna element and an outer conductor connected to the choke section.

18. A whip antenna as in claim 15, wherein the choke and coaxial line sections include conductive cylindrical portions spaced from the outer conductor of said coaxial cable and further comprising:

dielectric material between said conductive cylindrical portions and said outer conductor.

19. A whip antenna, with switchable operative length for multi-band operation, comprising:

an upper antenna element having a vertical axis;

a coaxial cable section along said vertical axis and including an inner conductor coupled to the upper antenna element and an outer conductor;

a choke section below the upper antenna element and including a cylindrical portion encircling part of the cable section, the choke section coupled to said outer conductor;

first, second, third and fourth coaxial line sections respectively positioned below the choke section at successively lower positions and each including a cylindrical portion encircling part of the cable section; and a plurality of switch devices arranged to selectively couple to the choke section one of (a) the first coaxial line section, (b) the first and second coaxial line sections, (c) the first, second and third coaxial line sections, and (d) the first second, third and fourth coaxial line sections.

20. A whip antenna as in claim 19, further comprising:

a driver configuration coupled to the switch devices to enable selective activation thereof to couple the coaxial line sections in any one of said (a), (b), (c) and (d) combinations with the choke section.

21. A whip antenna as in claim 19, further comprising:

dielectric material between said cylindrical portions and the outer conductor of the cable section.

22. A whip antenna as in claim 19, further comprising:

a cylindrical radome enclosing at least the upper antenna element, choke section and coaxial line sections.

23. A whip antenna, with switchable operative length for multi-band operation, comprising:

an upper antenna element having a vertical axis;

a coaxial cable section along said vertical axis and including an inner conductor coupled to the upper antenna element and an outer conductor;

a choke section below the upper antenna element and including a cylindrical portion encircling part of the cable section, the choke section coupled to said outer conductor;

first, second, third and fourth coaxial line sections respectively positioned below the choke section at successively lower positions and each including a cylindrical portion encircling part of the cable section; and a plurality of switch devices arranged to selectively couple to the choke section one of (a) the first coaxial line section, (b) the first and second coaxial line sections, (c) the first, second and third coaxial line sections, and (d) the first second, third and fourth coaxial line sections;

wherein components of the antenna have nominal vertical dimensions as follows:
upper antenna element, 1.30 meters;
choke section, 0.60 meters;
first coaxial line section, 0.52 meters;
second coaxial line section, 0.36 meters;
third coaxial line section, 0.13 meters; and
fourth coaxial line section, 0.08 meters.

24. A whip antenna as in claim 23, wherein the coaxial cable section has a nominal outside diameter of 7 millimeters and the choke section has a nominal inside diameter of 19 millimeters.

25. A whip antenna as in claim 23, wherein the antenna is configured for operation in any one of the following bands 44–50 MHZ, 50–58 MHZ, 58–70 MHZ, 70–80 MHZ and 80–90 MHZ, by selective activation of the switch devices.

26. A whip antenna as in claim 23, further comprising:

at least one transmission line section non-coaxial to said vertical axis; and at least one additional switch device arranged to selectively couple said at least one transmission line section in series with said coaxial line sections;

said driver configuration coupled to said at least one additional switch device to enable selective activation thereof.

27. A whip antenna as in claim 26, further comprising:

at least one additional transmission line section non-coaxial to said vertical axis;

the antenna configured for operation in frequency bands including any one of the following bands 30–38 MHZ, 38–44 MHZ, 44–50 MHZ, 50–58 MHZ, 58–70 MHZ, 70–80 MHZ and 80–90 MHZ.

* * * * *